US007211125B2

(12) United States Patent
Soda et al.

(10) Patent No.: US 7,211,125 B2
(45) Date of Patent: May 1, 2007

(54) ALLOYED STEEL POWDER WITH IMPROVED DEGREE OF SINTERING FOR METAL INJECTION MOLDING AND SINTERED BODY

(75) Inventors: Yuji Soda, Utsunomiya (JP); Michitaka Aihara, Kawahigashi-machi (JP)

(73) Assignee: Mitsubishi Steel Mfg. Co., Ltd., Tokyo (JP)

( * ) Notice: Subject to any disclaimer, the term of this patent is extended or adjusted under 35 U.S.C. 154(b) by 37 days.

(21) Appl. No.: 10/527,900

(22) PCT Filed: Feb. 10, 2004

(86) PCT No.: PCT/JP2004/001422

§ 371 (c)(1),
(2), (4) Date: Mar. 14, 2005

(87) PCT Pub. No.: WO2004/072315

PCT Pub. Date: Aug. 26, 2004

(65) Prior Publication Data

US 2006/0162494 A1 Jul. 27, 2006

(30) Foreign Application Priority Data

Feb. 13, 2003 (JP) ..... 2003-035619
Dec. 24, 2003 (JP) ..... 2003-426678

(51) Int. Cl.

| | |
|---|---|
| ***C22C 38/02*** | (2006.01) |
| ***C22C 38/04*** | (2006.01) |
| ***C22C 38/26*** | (2006.01) |
| ***C22C 38/36*** | (2006.01) |
| ***B22F 1/02*** | (2006.01) |

(52) U.S. Cl. ..... 75/246; 75/255; 75/243

(58) Field of Classification Search ..... 75/243, 75/246, 252, 255

See application file for complete search history.

(56) References Cited

U.S. PATENT DOCUMENTS

| | | | | |
|---|---|---|---|---|
| 2,430,671 | A * | 11/1947 | Feild | 75/567 |
| 4,917,961 | A * | 4/1990 | Tsujii et al. | 428/552 |
| 5,449,536 | A | 9/1995 | Funkhouser et al. | |
| 5,856,625 | A * | 1/1999 | Saunders et al. | 75/236 |
| 6,342,087 | B1 * | 1/2002 | Arvidsson et al. | 75/255 |
| 2003/0033903 | A1 * | 2/2003 | Bergkvist et al. | 75/246 |
| 2003/0133824 | A1 * | 7/2003 | Taguchi et al. | 420/70 |

FOREIGN PATENT DOCUMENTS

| | | |
|---|---|---|
| JP | 6-198713 | 7/1994 |
| JP | 7-242903 | 9/1995 |
| JP | 9-53159 | 2/1997 |
| JP | 11-181501 | 7/1999 |

* cited by examiner

*Primary Examiner*—Ngoclan T. Mai
(74) *Attorney, Agent, or Firm*—Flynn, Thiel, Boutell & Tanis, P.C.

(57) ABSTRACT

An alloyed steel powder for metal injection molding that eliminates the problems of decreased product strength and difficulty of temperature control which exist in conventional alloys for sintering and that improves productivity of the sintering furnace is provided, together with a sintered body thereof. This alloyed steel powder for metal injection molding consists, as mass percentages, of 0.1 to 1.8% C, 0.3 to 1.2% Si, 0.1 to 0.5% Mn, 11 to 18% Cr, 2 to 5% Nb and the remainder Fe and unavoidable impurities, and which may further comprise 5.0% or less of at least one of Mo, V and W, or a sintered body (wherein C is 0.1 to 1.7%) of these powders. The alloyed steel powder for metal injection molding of the present invention results in a sintered body with a constant sintered density over a 50° C. range of sintering temperatures, thereby facilitating sintering temperature control and improving productivity.

4 Claims, 8 Drawing Sheets

ALLOYED STEEL POWDER WITH IMPROVED DEGREE OF SINTERING FOR METAL INJECTION MOLDING AND SINTERED BODY

TECHNICAL FIELD

The present invention relates to an alloyed steel powder for metal injection molding (MIM) which is effective in making complex-shaped parts of very hard, highly corrosion resistant martensite stainless steel or tools of alloyed steel with a good dimensional precision, and relates to a sintered body.

BACKGROUND ART

SKD11, SUS420, SUS440C and the like have conventionally been used as metal injection molding powders for obtaining very hard, highly corrosion-resistant sintered bodies. These steels, in which the hardness is obtained mainly by the use of Cr carbide, exhibit an austenite phase in the sintering temperature range, and have a poor degree of sintering because the speed of elemental movement (diffusion) which promotes sintering is slower than in a ferrite phase. On the other hand, if the temperature is raised to the temperature at which a liquid phase appears in order to promote sintering, a large amount of liquid phase arises at once, carbides are formed as networks at the grain boundaries, and either the strength of the product is seriously diminished or it is deformed to the point that the shape of the product cannot be maintained. To avoid these, it is necessary to proceed with the sintering temperature controlled within an extremely narrow temperature range of ±5° C. or in other words about 10° C. Because of this, it has been necessary to limit the usable region of the sintering furnace, sacrificing productivity.

DISCLOSURE OF THE INVENTION

It is an object of the present invention to eliminate the aforementioned diminishment of product strength and difficulty of controlling sintering temperature which are problems of the aforementioned conventional sintering alloys, and to provide an alloyed steel powder for metal injection molding and a sintered body which contribute to enhancing the product's characteristics and improving the productivity of the sintering furnace.

In order to solve the aforementioned problems, the present invention has the following constitution.

(1) An alloyed steel powder for metal injection molding with an improved degree of sintering, consisting, as mass percentages, of 0.1 to 1.8% C, 0.3 to 1.2% Si, 0.1 to 0.5% Mn, 11.0 to 18.0% Cr, 2.0 to 5.0% Nb, and a remainder of Fe and unavoidable impurities.

(2) An alloyed steel powder for metal injection molding with an improved degree of sintering, consisting, as mass percentages, of 0.1 to 1.8% C, 0.3 to 1.2% Si, 0.1 to 0.5% Mn, 11.0 to 18.0% Cr, 5.0% or less of at least one of Mo, V and W, 2.0 to 5.0% Nb, and a remainder of Fe and unavoidable impurities.

(3) An alloyed steel powder for metal injection molding with an improved degree of sintering according to (2) above, wherein the amount of the at least one of Mo, V and W is 0.3 to 1.6%.

(4) An alloyed steel sintered body for metal injection molding with an improved degree of sintering, consisting, as mass percentages, of 0.1 to 1.7% C, 0.3 to 1.2% Si, 0.1 to 0.5% Mn, 11.0 to 18.0% Cr, 2.0 to 5.0% Nb, and a remainder of Fe and unavoidable impurities.

(5) An alloyed steel sintered body for metal injection molding with an improved degree of sintering, consisting, as mass percentages, of 0.1 to 1.7% C, 0.3 to 1.2% Si, 0.1 to 0.5% Mn, 11.0 to 18.0% Cr, 5.0% or less of at least one of Mo, V and W, 2.0 to 5.0% Nb, and a remainder of Fe and unavoidable impurities.

(6) An alloyed steel sintered body for metal injection molding with an improved degree of sintering according to (5) above, wherein the at least one of Mo, V and W is 0.3 to 1.6%.

The focus of the present invention is on producing a Nb carbide with a low diffusion by adding Nb to a steel alloyed primarily with Cr carbide. Because this Nb carbide has a low diffusion speed, it is unlikely to bulk by diffusion during sintering of the metal injection molded product, and the Cr carbide is also precipitated around the core of this Nb carbide.

Using the pinning effect of this Nb carbide, it is possible to prevent bulking and network formation of the carbide more effectively than when only Cr carbide is present.

In the constitution of the present invention, C forms carbides and contributes hardness, resulting in a martensite structure. 0.1 to 1.8% is desirable as the amount range of C in the powder. The sintering temperature and sintered density vary according to the amount of C. Consequently, graphite is added appropriately during the molding of the powder to adjust the amount of C in the sintered product to 0.1 to 1.7%. A sintered body with a high sintered density can be manufactured under an easy temperature control. The lower limit of 0.1% in both the powder and sintered body was set because that is the minimum amount necessary to produce the aforementioned Nb carbide and because it is the minimum amount at which the C would dissolve in the matrix to form martensite. The upper limits of 1.8% in the powder and 1.7% in the sintered body were set considering the amount of C that is lost from the powder during sintering because at this level C contributes to hardness by forming a Cr carbide in the sintered body, but in an amount above 1.7% hardness is not further improved and, to the contrary, toughness (transverse rupture strength) is diminished.

Si improves deoxidation and hot water flow. If the amount is less than 0.3%, the oxygen amount rises and hot water flow is adversely affected, while if it is more than 1.2%, hardenability is adversely affected.

If Mn is less than 0.1%, hot water flow is adversely affected, while if it is over 0.5%, it combines with oxygen, increasing the amount of oxygen in the powder. Consequently, it is set in the range of 0.1 to 0.5%.

Cr improves hardenability and increases hardness by producing carbides. It also dissolves in the matrix including the carbides, thereby, it improves corrosion resistance. A range of 11.0 to 18.0% is desirable.

Mo, V and W produce carbides, and together with Nb have a pinning effect on the Cr carbides, therefore, they enhance the strength and hardness of the sintered body. If these are more than 5.0%, toughness will be diminished so 5.0% or less is desirable, and a range of 0.3 to 1.6% is more desirable from the standpoint of hardenability and cost-effectiveness. A noticeable improvement in hardness is difficult to achieve below 0.3%, while more than 1.6% is not cost-effective.

Nb controls diffusion of Cr carbides and improves hardenability by means of the pinning effect of low-diffusion Nb carbides. By adding 2.0 to 5.0% Nb, it is possible to improve the productivity of the sintering furnace because the sintering temperature needs only to be controlled within ±25° C. rather than within ±5° C., as is required conventionally. This effect isn't sufficient if the amount of Nb is less than 2.0%, while if it exceeds 5.0%, the amount of oxygen increases and the moldability is adversely affected.

BEST MODE FOR CARRYING OUT THE INVENTION

The samples shown in Table 1 below were prepared and their sintering characteristics tested.

TABLE 1

| Steel | Composition (%) | | | | | | | | | | Dm | T/D |
|---|---|---|---|---|---|---|---|---|---|---|---|---|
| type | C | Si | Mn | Cr | Mo | V | W | Nb | O | Fe | (μm) | (g/cm$^3$) |
| SKD11 | 1.66 | 0.34 | 0.44 | 11.80 | 1.02 | — | — | — | 3300 | Remainder | 11.90 | 4.04 |
| SUS420 | 0.27 | 0.85 | 0.33 | 13.09 | 0.59 | — | — | — | 3200 | Remainder | 10.01 | 4.30 |
| SUS440C | 0.96 | 0.91 | 0.18 | 17.12 | 0.05 | 0.07 | — | — | 2700 | Remainder | 9.72 | 4.21 |
| Comp. Example 1 | 0.60 | 0.73 | 0.47 | 12.53 | 1.49 | — | — | 0.34 | 3900 | Remainder | 10.22 | 4.27 |
| Example 1 | 1.03 | 0.92 | 0.22 | 17.01 | — | — | — | 3.01 | 4100 | Remainder | 9.92 | 4.17 |
| Example 2 | 0.66 | 0.88 | 0.44 | 12.18 | 1.42 | — | — | 3.22 | 4200 | Remainder | 10.98 | 4.18 |
| Example 3 | 0.96 | 0.87 | 0.21 | 17.12 | 0.41 | 0.17 | 0.08 | 2.99 | 3400 | Remainder | 9.86 | 4.08 |
| Example 4 | 0.56 | 0.93 | 0.31 | 12.34 | 0.50 | — | — | 2.81 | 2500 | Remainder | 9.92 | 4.17 |
| Comp. Example 2 | 0.65 | 0.89 | 0.45 | 12.15 | 1.46 | — | — | 7.33 | 13500 | Remainder | 10.34 | 4.20 |

The C amount of each sample was adjusted. Graphite powder was added with the aim of achieving C amounts after sintering of 1.30%, 1.50% and 1.70% for SKD11, 0.30%, 0.50%, 0.70% and 0.90% for SUS420, 1.30% for Example 1, 0.75%, 0.80%, 1.00% and 1.20% for SUS440C, 0.50%, 0.70% and 0.90% for Comparative Example 1 and Example 2, 1.30% for Example 3 and 0.90% for Example 4. A sintering test was not performed in the case of Comparative Example 2 because the amount of oxygen was too great at the powder stage.

The sintering test was performed as follows.

A suitable amount of graphite powder was added to each of the metal powders shown in Table 1, based on the target amount of C after sintering, 5.0 wt % of stearic acid (outer number) was added to the powder, and uniform kneading was performed with heating at 80° C.

The kneaded products were cooled to room temperature, and the solidified pellets were pulverized. The pulverized pellets were press molded at a molding pressure of 0.6 Ton/cm$^2$ (Ø11.3×10t, N=3).

Figure 1:
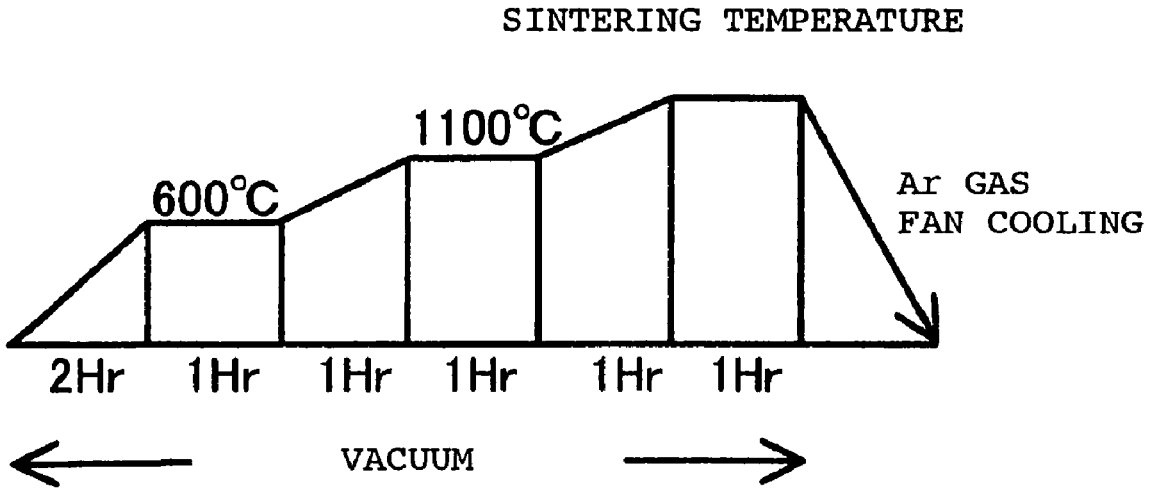
FIG. 1 shows a pattern of sintering performed in an example of the present invention.
Figure 2:
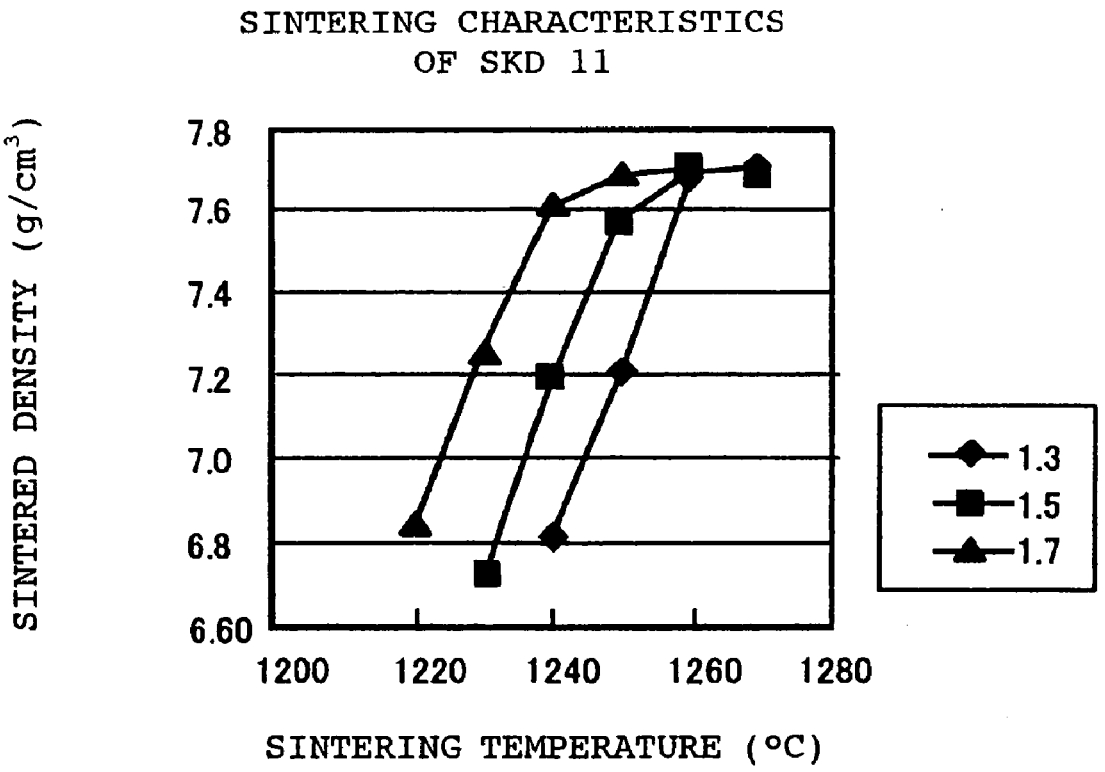
FIG. 2 is a graph of the sintering characteristics of SKD11.
Figure 3:
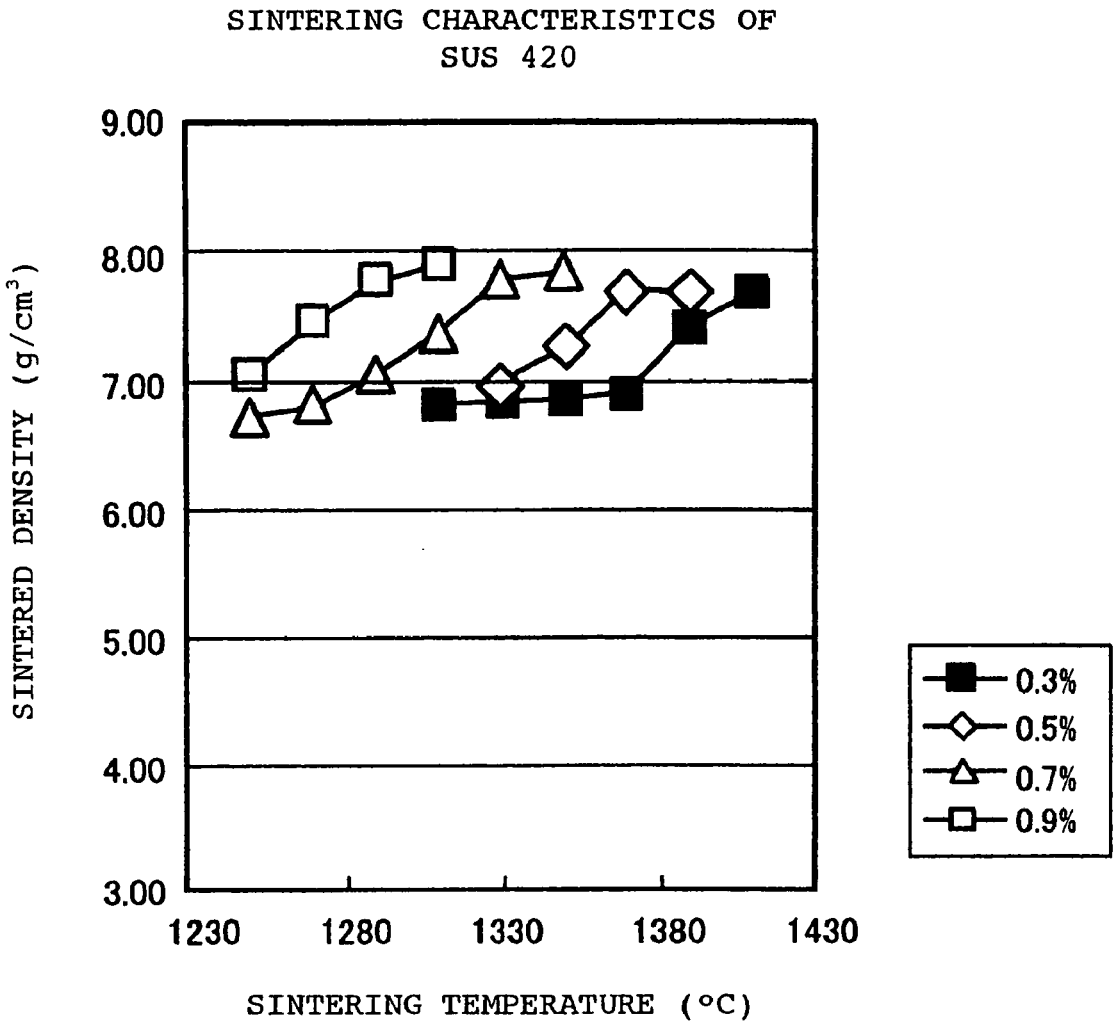
FIG. 3 is a graph of the sintering characteristics of SUS420.
Figure 4:
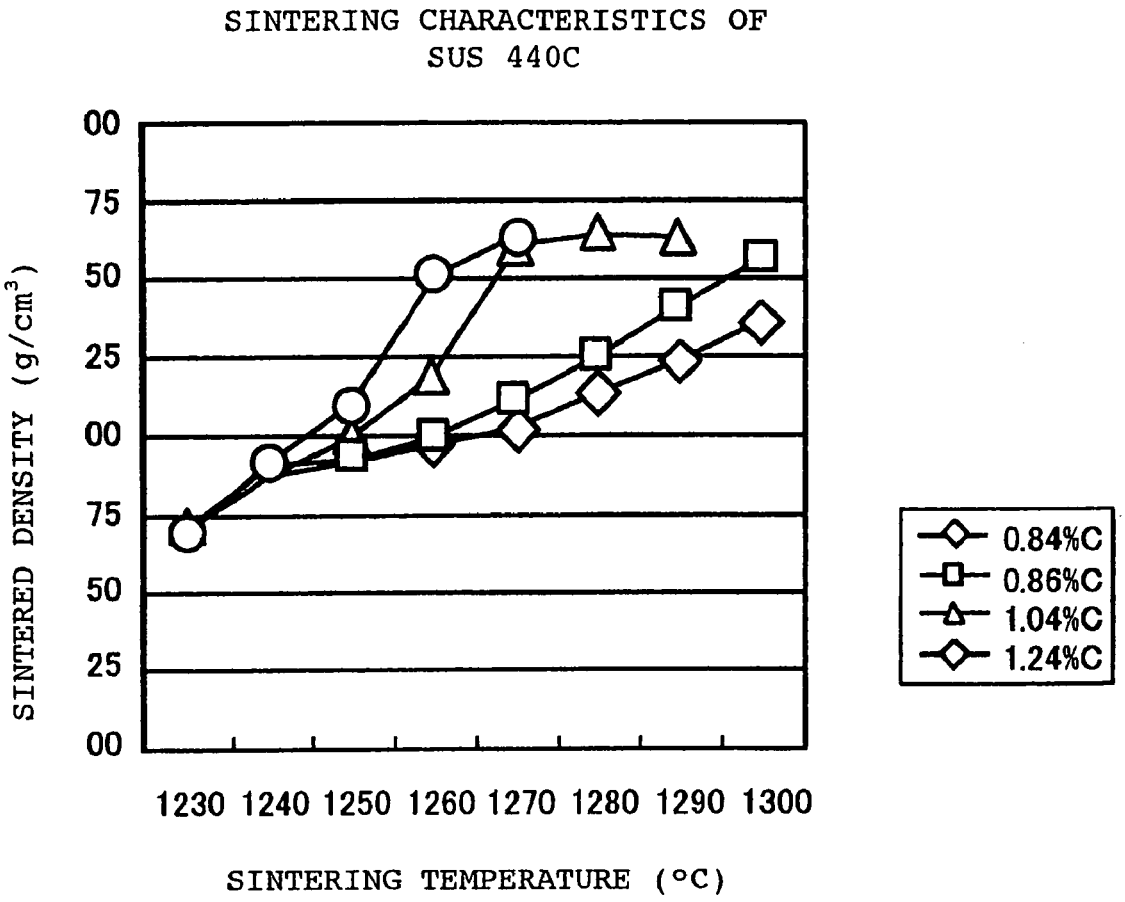
FIG. 4 is a graph of the sintering characteristics of SUS440C.
Figure 5:
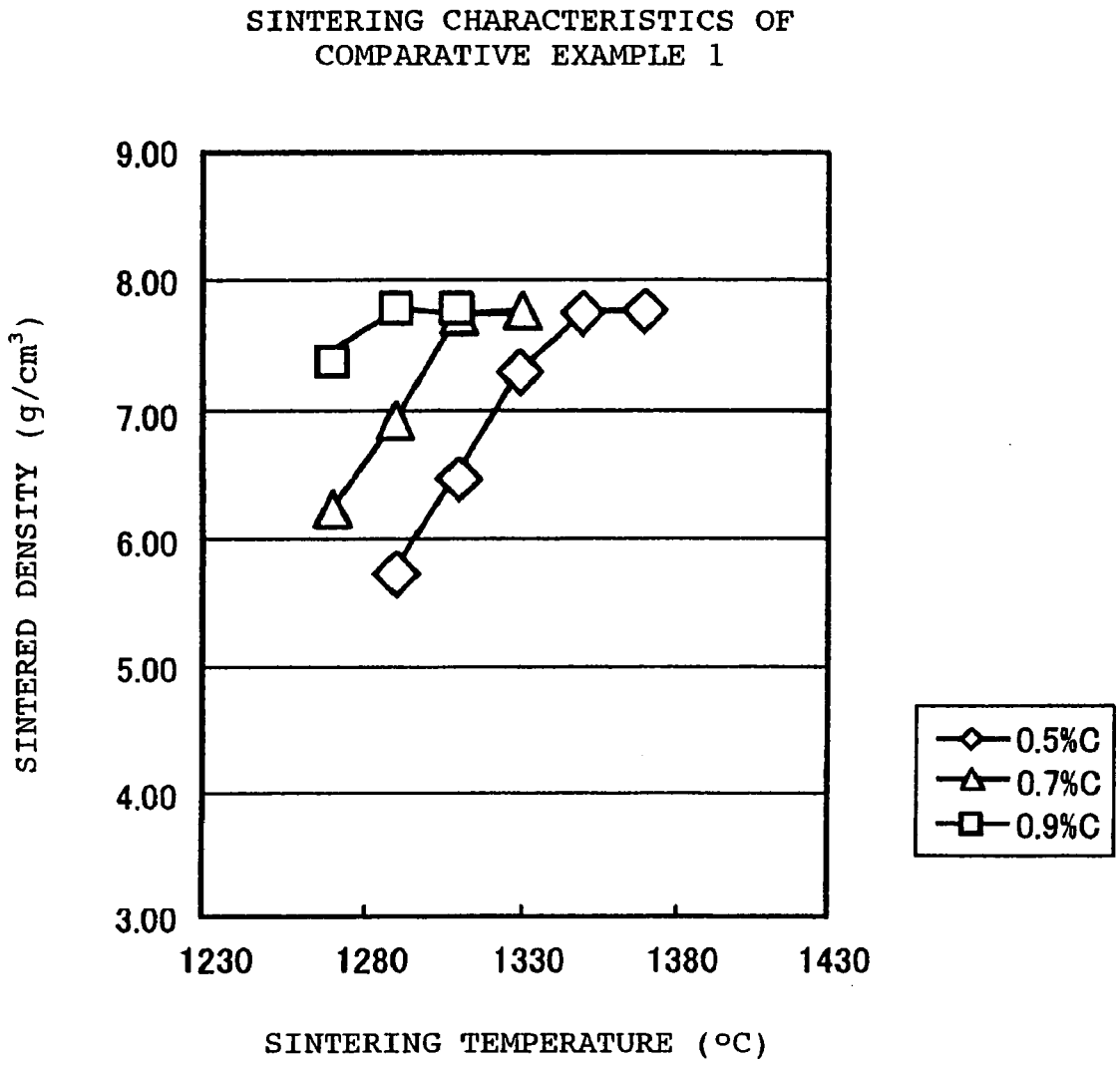
FIG. 5 is a graph of the sintering characteristics of Comparative Example 1.
Figure 6:
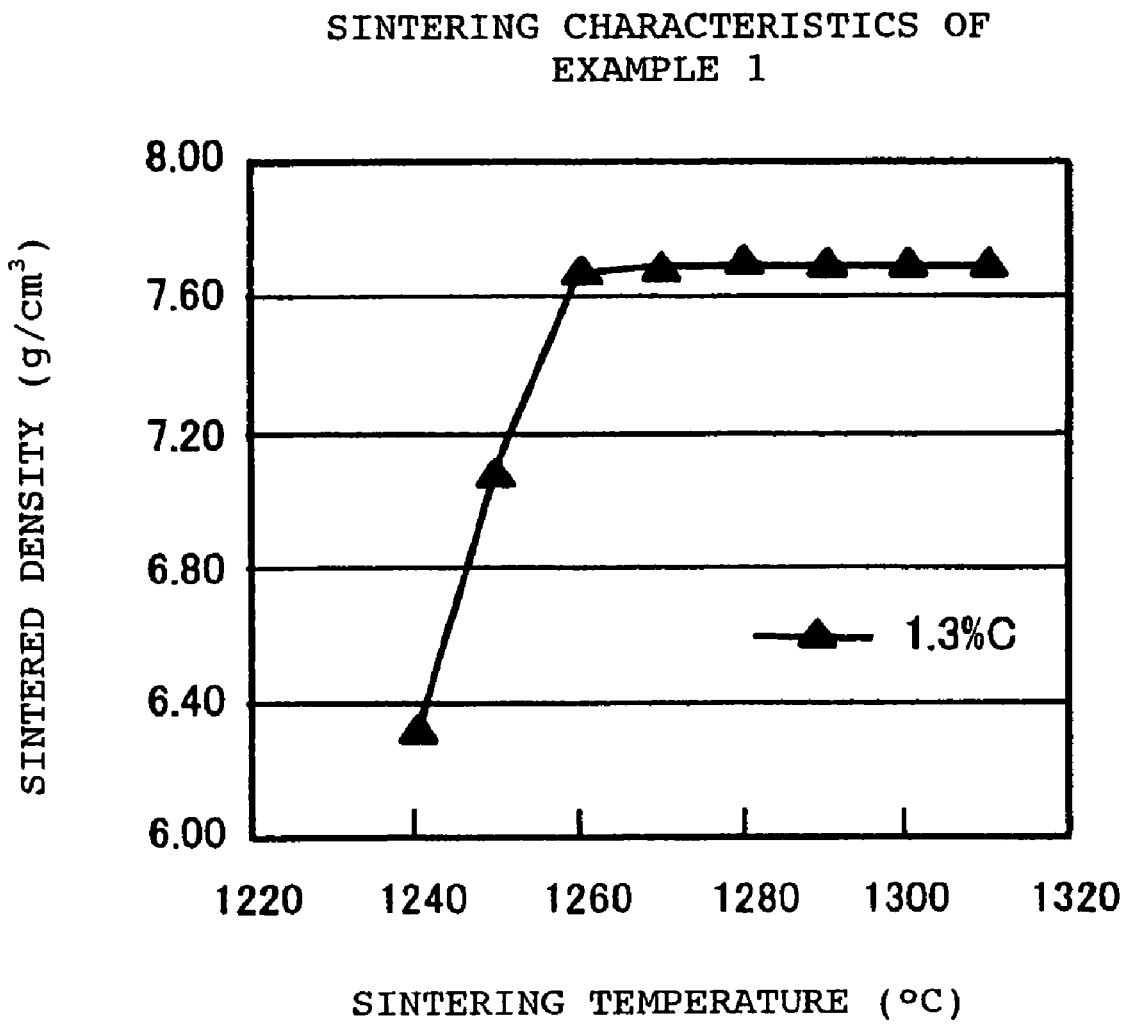
FIG. 6 is a graph of the sintering characteristics of Example 1 of the present invention.
Figure 7:
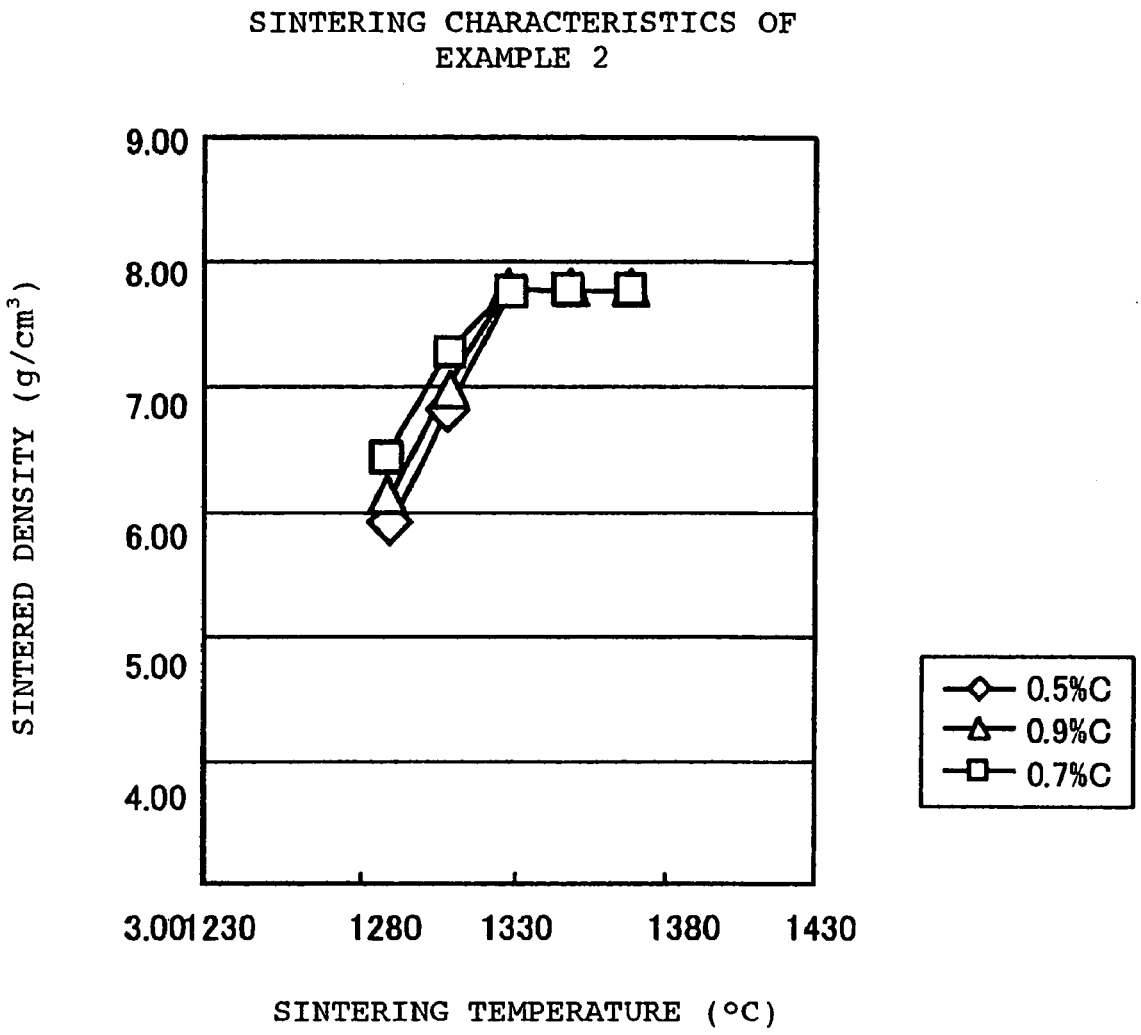
FIG. 7 is a graph of the sintering characteristics of Example 2 of the present invention.
Figure 8:
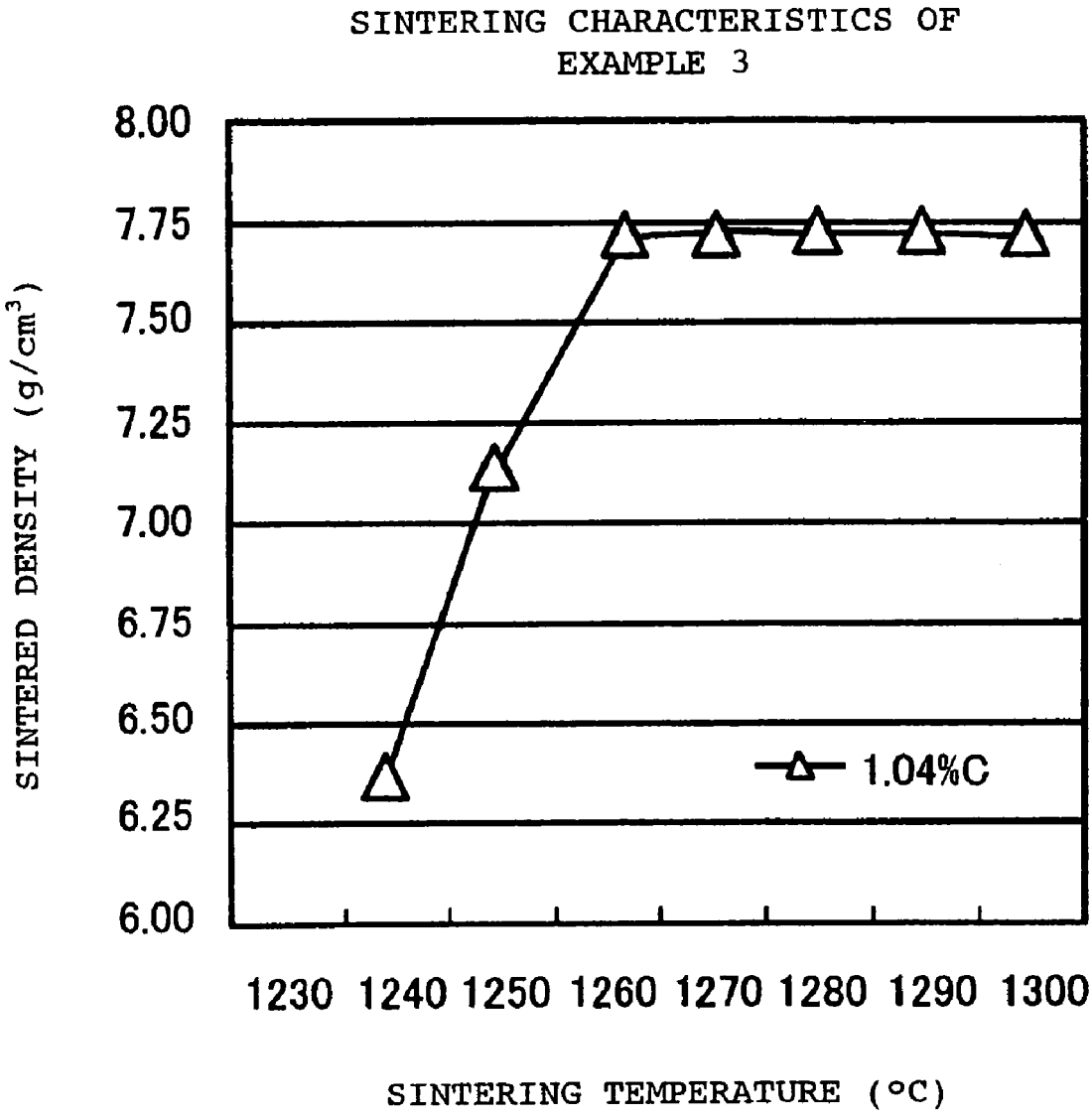
FIG. 8 is a graph of the sintering characteristics of Example 3 of the present invention.
Figure 9:
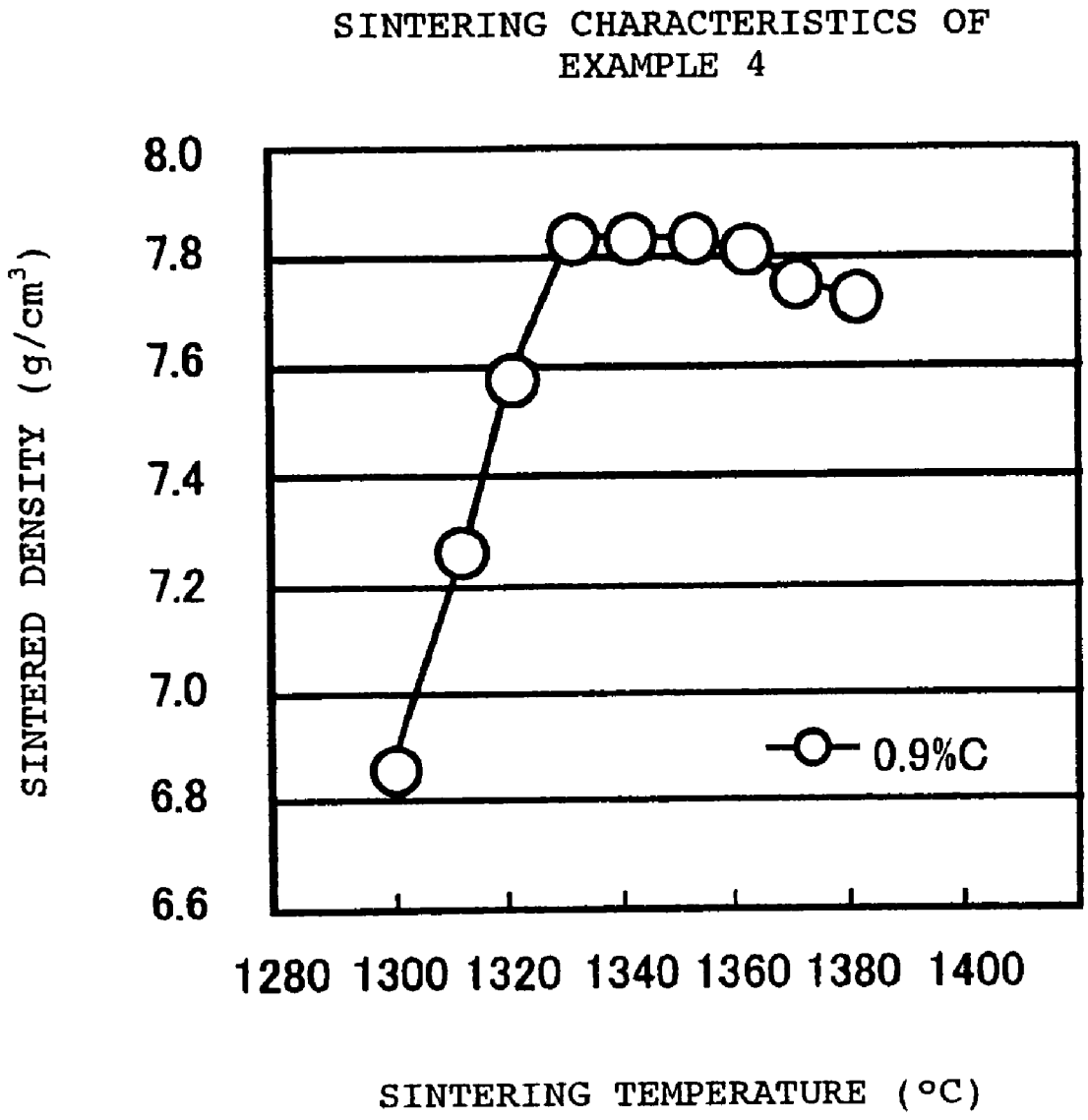
FIG. 9 is a graph of the sintering characteristics of Example 4 of the present invention.

Sintering was performed according to the pattern shown in FIG. 1. In FIG. 1, the sintering temperatures were the appropriate temperatures shown in Tables 2 through 5, such as 1370° C., 1390° C. and 1410° C.

Tables 2 through 5 show the sintered density of each sample at different sintering temperatures and for different target amounts of carbon after sintering. The amounts of C, 0 and N in the sintered products of each sample are shown at the bottom of Tables 2 through 5, along with sintered hardness (Hv) in the case of Tables 4 and 5. The sintering characteristics shown in Tables 2 through 5 are also shown in graph form in FIGS. 2 through 9.

The structures were observed and the hardness of the sintered bodies was measured to determine the respective appropriate control ranges of sintering temperature. The appropriate control range of sintering temperature was the sintering temperature range within which the sintered density remained nearly constant within a range of ±0.1 g/cm$^3$ as the sintering temperature rose on the sintering temperature-sintered density graph.

TABLE 2

| | | SKD11 Target C amount (%) after sintering | | | | | SUS420 Target C amount (%) after sintering | | | |
|---|---|---|---|---|---|---|---|---|---|---|
| Steel type | | 1.30 | 1.50 | 1.70 | Steel type | | 0.30 | 0.50 | 0.70 | 0.90 |
| Molded product Density | | 4.91 | 4.90 | 4.88 | Molded product density | | 4.85 | 4.81 | 4.78 | 4.76 |
| Sintering | 1220 | — | — | 6.84 | Sintering | 1250 | — | — | 6.75 | 7.07 |
| Tempera- | 1230 | — | 6.71 | 7.25 | Tempera- | 1270 | — | — | 6.82 | 7.47 |
| ture (° C.) | 1240 | 6.81 | 7.20 | 7.61 | ture (° C.) | 1290 | — | — | 7.06 | 7.78 |
| | 1250 | 7.21 | 7.58 | 7.69 | | 1310 | 6.82 | — | 7.38 | 7.91 |
| | 1260 | 7.68 | 7.70 | 7.69 | | 1330 | 6.84 | 6.98 | 7.79 | — |
| | 1270 | 7.71 | 7.69 | — | | 1350 | 6.86 | 7.27 | 7.85 | — |
| | — | — | — | — | | 1370 | 6.92 | 7.70 | — | — |
| | — | — | — | — | | 1390 | 7.41 | 7.69 | — | — |
| | — | — | — | — | | 1410 | 7.70 | — | — | — |
| C (%) | | 1.28 | 1.47 | 1.66 | C (%) | | 0.33 | 0.57 | 0.79 | 0.99 |
| O (ppm) | | 11 | 10 | 11 | O (ppm) | | 17 | 40 | 27 | 41 |
| N (ppm) | | 7 | 8 | 9 | N (ppm) | | 3 | 4 | 1 | 3 |

TABLE 3

| | | SUS440C Target C amount (%) after sintering | | | | | Comparative Example 1 Target C amount (%) after sintering | | |
|---|---|---|---|---|---|---|---|---|---|
| Steel type | | 0.75 | 0.80 | 1.00 | 1.20 | Steel type | 0.50 | 0.70 | 0.90 |
| Molded product density | | 5.01 | 5.00 | 4.96 | 4.94 | Molded product density | 4.68 | 4.69 | 4.69 |
| Sintering | 1230 | — | — | 6.72 | 6.70 | Sintering | 1270 | 5.44 | 6.23 | 7.38 |
| tempera- | 1240 | 6.88 | 6.91 | 6.88 | 6.93 | tempera- | 1290 | 5.71 | 6.92 | 7.77 |
| ture(° C.) | 1250 | 6.93 | 6.94 | 7.00 | 7.10 | ture(° C.) | 1310 | 6.50 | 7.75 | 7.77 |
| | 1260 | 6.97 | 7.00 | 7.19 | 7.52 | | 1330 | 7.31 | 7.76 | — |
| | 1270 | 7.03 | 7.12 | 7.61 | 7.63 | | 1350 | 7.77 | — | — |
| | 1280 | 7.14 | 7.26 | 7.64 | — | | 1370 | 7.77 | — | — |
| | 1290 | 7.24 | 7.41 | 7.63 | — | | — | — | — | — |
| | 1300 | 7.36 | 7.56 | — | — | | — | — | — | — |
| | — | — | — | — | — | | — | — | — | — |
| C (%) | | 0.84 | 0.86 | 1.04 | 1.24 | C (%) | 0.54 | 0.76 | 0.96 |
| O (ppm) | | 130 | 60 | 42 | 34 | O (ppm) | 21 | 14 | 20 |
| N (ppm) | | 7 | 7 | 5 | 6 | N (ppm) | 3 | 2 | 13 |

TABLE 4

| | | Example 1 Target C amount (%) after sintering | | | | | Example 2 Target C amount (%) after sintering | | |
|---|---|---|---|---|---|---|---|---|---|
| Steel type | | 1.30 | | | Steel type | | 0.50 | 0.70 | 0.90 |
| Molded product density | | 4.41 | | | Molded product density | | 4.56 | 4.55 | 4.56 |
| Sintering | 1240 | 6.34 | | | Sintering | 1290 | 5.88 | 6.12 | 6.44 |
| tempera- | 1250 | 7.10 | | | tempera- | 1310 | 6.79 | 6.98 | 7.27 |
| ture (° C.) | 1260 | 7.68 | | | ture (° C.) | 1330 | 7.76 | 7.76 | 7.76 |
| | 1270 | 7.69 | | | | 1350 | 7.76 | 7.75 | 7.75 |
| | 1280 | 7.70 | | | | 1370 | 7.77 | 7.76 | 7.77 |
| | 1290 | 7.70 | | | | — | — | — | — |
| | 1300 | 7.69 | | | | — | — | — | — |
| | 1310 | 7.70 | | | | — | — | — | — |
| | — | — | | | | — | — | — | — |
| C (%) | | 1.25 | | | C (%) | | 0.52 | 0.73 | 0.94 |
| O (ppm) | | 11 | | | O (ppm) | | 26 | 22 | 32 |
| N (ppm) | | 7 | | | N (ppm) | | 10 | 8 | 7 |
| Sintered hardness (Hv) | | 700 | | | Sintered hardness (Hv) | | 600 | 640 | 310 |

TABLE 5

| Steel type | | Example 3 Target C amount (%) after sintering 1.30 | Steel type | | Example 4 Target C amount (%) after sintering 0.90 |
|---|---|---|---|---|---|
| Molded product density | | 4.85 | Molded product density | | 4.85 |
| Sintering temperature (° C.) | 1230 | — | Sintering temperature (° C.) | 1300 | 6.84 |
| | 1240 | 6.37 | | 1310 | 7.25 |
| | 1250 | 7.14 | | 1320 | 7.58 |
| | 1260 | 7.71 | | 1330 | 7.83 |
| | 1270 | 7.72 | | 1340 | 7.83 |
| | 1280 | 7.72 | | 1350 | 7.83 |
| | 1290 | 7.72 | | 1360 | 7.79 |
| | 1300 | 7.71 | | 1370 | 7.77 |
| | 1310 | 7.72 | | 1380 | 7.75 |
| C (%) | | 1.35 | C (%) | | 0.94 |
| O (ppm) | | 46 | O (ppm) | | 11 |
| N (ppm) | | 28 | N (ppm) | | 9 |
| Sintered hardness (Hv) | | 749 | Sintered hardness (Hv) | | 680 |

As discussed above, in the alloyed steel powder for metal injection molding of the present invention containing Nb, the appropriate sintering temperature control range is greater than in the case of SKD11, SUS420 and SUS440C. That is, while the appropriate sintering temperature control range is about 10° C. in the case of SKD11, SUS420 and SUS440C, in the present invention it is broadened to about 50° C., facilitating sintering temperature control and improving productivity. The sensitivity to C value after sintering is also weaker, and almost the same sintering characteristics (temperature vs. density) are obtained with C values of 0.5 to 0.9%.

The invention claimed is:

1. An alloyed steel powder for metal injection molding with improved degree of sintering, consisting as mass percentages of 0.1 to 1.8% C, 0.3 to 1.2% Si, 0.1 to 0.5% Mn, 11.0 to 18.0% Cr, 2.0 to 5.0% Nb, and a remainder of Fe and unavoidable impurities.

2. An alloyed steel powder for metal injection molding with improved degree of sintering, consisting as mass percentages of 0.1 to 1.8% C, 0.3 to 1.2% Si, 0.1 to 0.5% Mn, 11.0 to 18.0% Cr, 0.3 to 1.6% of at least one of Mo, V and W, 2.0 to 5.0% Nb, and a remainder of Fe and unavoidable impurities.

3. An alloyed steel sintered body for metal injection molding with improved degree of sintering, consisting as mass percentages of 0.1 to 1.7% C, 0.3 to 1.2% Si, 0.1 to 0.5% Mn, 11.0 to 18.0% Cr, 2.0 to 5.0% Nb, and a remainder of Fe and unavoidable impurities.

4. An alloyed steel sintered body for metal injection molding with improved degree of sintering, consisting as mass percentages of 0.1 to 1.7% C, 0.3 to 1.2% Si, 0.1 to 0.5% Mn, 11.0 to 18.0% Cr, 0.3 to 1.6% of at least one of Mo, V and W, 2.0 to 5.0% Nb, and a remainder of Fe and unavoidable impurities.

* * * * *